US007906201B2

(12) United States Patent
Schwenk et al.

(10) Patent No.: US 7,906,201 B2
(45) Date of Patent: Mar. 15, 2011

(54) VALUE DOCUMENT

(75) Inventors: Gerhard Schwenk, Puchheim (DE); Thomas Giering, Kirchseeon (DE)

(73) Assignee: Giesecke & Devrient GmbH, Munich (DE)

( * ) Notice: Subject to any disclaimer, the term of this patent is extended or adjusted under 35 U.S.C. 154(b) by 1086 days.

(21) Appl. No.: 10/575,080

(22) PCT Filed: Oct. 5, 2004

(86) PCT No.: PCT/EP2004/011135

§ 371 (c)(1),
(2), (4) Date: Jan. 24, 2007

(87) PCT Pub. No.: WO2005/035272

PCT Pub. Date: Apr. 21, 2005

(65) Prior Publication Data

US 2007/0257482 A1 Nov. 8, 2007

(30) Foreign Application Priority Data

Oct. 8, 2003 (DE) ..... 103 46 631

(51) Int. Cl.
*B41M 3/10* (2006.01)
*B44C 5/04* (2006.01)
*G03G 7/00* (2006.01)

(52) U.S. Cl. ..... 428/211.1; 428/195.1; 428/690; 428/916; 283/72; 283/74; 283/75; 283/86; 283/94; 283/901; 283/904

(58) Field of Classification Search ..... 428/195.1, 428/211.1, 690, 916; 283/72, 74, 75, 86, 283/94, 901, 904
See application file for complete search history.

(56) References Cited

U.S. PATENT DOCUMENTS

| | | | | |
|---|---|---|---|---|
| 6,155,605 | A | 12/2000 | Bratchley et al. | |
| 6,165,592 | A | 12/2000 | Berger et al. | |
| 6,234,537 | B1 * | 5/2001 | Gutmann et al. | 283/86 |
| 6,383,618 | B1 | 5/2002 | Kaule et al. | |
| 6,530,527 | B1 * | 3/2003 | Ahlers et al. | 235/491 |
| 6,786,954 | B1 * | 9/2004 | Lee et al. | 106/31.13 |
| 2002/0188845 | A1 * | 12/2002 | Henderson et al. | 713/168 |
| 2005/0052519 | A1 | 3/2005 | Mayer et al. | |
| 2007/0158433 | A1 * | 7/2007 | Schwenk et al. | 235/487 |

FOREIGN PATENT DOCUMENTS

| | | | |
|---|---|---|---|
| DE | 198 03 997 | A1 | 8/1999 |
| DE | 198 60 093 | A1 | 7/2000 |
| DE | 101 20 818 | A1 | 10/2002 |
| EP | 0 052 624 | | 6/1982 |
| EP | 0 053 124 | | 6/1982 |
| EP | 0 659 935 | | 6/1995 |
| GB | 2 016 370 | A | 9/1979 |
| WO | WO 97/39428 | | 10/1997 |
| WO | WO 03/032243 | A1 | 4/2003 |

* cited by examiner

*Primary Examiner* — Mark Ruthkosky
*Assistant Examiner* — David J Joy
(74) *Attorney, Agent, or Firm* — Bacon & Thomas PLLC

(57) ABSTRACT

The invention relates to a value document, in particular a bank note, having a value document substrate and different feature substances for checking the value document. According to the invention, a first feature substance is incorporated into the volume of the substrate of the value document, and second and third feature substances are applied to the value document substrate in a printing ink jointly and in the form of a coding. The second feature substance is formed by a luminescent substance, and the third feature substance by a material absorbent in a special spectral range. The two substances are used for the value recognition of different user groups.

22 Claims, 2 Drawing Sheets

VALUE DOCUMENT

FIELD OF THE INVENTION

This invention relates to a value document, in particular a bank note, having a value document substrate and different feature substances for checking the value document.

BACKGROUND

The print WO 97/39428 discloses a value document whose substrate has, in one area, different machine authenticatable authenticity features for different security levels. The value document contains a machine authenticatable low security feature which is formed from a single material. Upon an interrogation the low security feature provides a yes/no response indicating the presence or absence of the interrogated property. The low security feature is used for authenticity checking in applications where a simple detector is used, for example retail outlets.

A further, likewise machine authenticatable high security feature has properties that are difficult to detect allowing an in-depth interrogation of the value document and a much higher level of authentication. The check of the high security feature is elaborate and effected for example in central banks. Said high security feature is a homogeneous mixture of two substances with different physical properties, such as the excitation wavelength for a luminescence emission or coercivity, etc.

The system known from WO 97/39428 has the disadvantage, however, of permitting an elaborate authenticity check of the value documents but not allowing any statement about the type or value of the particular value document. For machine processing of value documents, in particular bank notes, it is also desirable to detect by machine the type of document, e.g. the currency or the denomination of a known currency.

SUMMARY

On these premises the invention is based on the problem of proposing a generic value document that involves not only increased falsification security but at the same time also a possibility of value recognition.

Value recognition is understood in the context of the present invention to mean the evaluation of information present in coded form for a certain user group. The coded information can be, in the case of a bank note, for example the denomination, the currency, the series, the issuing country or other special features of the bank note.

The inventive value document has a first feature substance incorporated into the volume of the substrate of the value document, and second and third feature substances applied to the value document substrate in a printing ink jointly and in the form of a coding. The second feature substance is formed by a luminescent substance, and the third feature substance by a material absorbent in a special spectral range. As explained in detail hereinafter, this combination creates a complex feature system that is very difficult to imitate for a forger. The feature system permits users from different user groups to each carry out both an authenticity check and value recognition on the document. The feature substances, or their characteristic properties, used by the different user groups are completely separate from each other.

For example, users of a user group can use a characteristic property of the first feature substance for the authenticity check, and the absorbent material applied in coded form for value recognition. Users of another user group can employ a characteristic property, in particular the luminescence, of the second feature substance for the authenticity check, and use the coding formed by the luminescent substance for value recognition. This permits users from both user groups to carry out not only an authenticity check but also value recognition of the document without any great additional effort. The exact implementation of the authenticity check and the value recognition will be described in detail below.

Said user groups may be central banks, commercial banks, any commercial enterprises such as local train services, department stores or vending machine operators, etc.

Analysis of the total feature system is exceptionally difficult and elaborate, since it is not recognizable to third parties which substances and in particular which substance properties are used for the check by the different user groups. Even knowledge of the procedure of one user group does not yet reveal the substances and methods used for the authenticity check and value recognition by the other user group or groups.

According to a preferred embodiment of the invention, the first feature substance is distributed substantially uniformly within the volume of the value document substrate, so that sufficiently large volume elements of equal size each contain a substantially equal quantity of the first feature substance. The distribution of the first feature substance can be regular, and be effected for example in a given pattern. However, the first feature substance is preferably incorporated into the substrate volume with a random distribution.

The marking substance can also be incorporated into the near-surface volume area of the paper substrate. Suitable methods for this purpose are for example those described in the prints EP-A-0 659 935 and DE 101 20 818, in which the particles of the first marking substance are admixed to a gas stream or a liquid stream and incorporated into a wet paper web. The disclosures of the stated prints are included in the present application in this respect.

The third feature substance selected is preferably a feature substance absorbent in the infrared spectral range. "Infrared spectral range" is understood according to the invention to be the wavelength range from 750 nm and more, preferably 800 nm and more. In particular, the third feature substance is preferably substantially colorless or has only weak inherent color in the visible spectral range. The third feature substance is then not recognizable or not very striking under ordinary lighting conditions. Furthermore, unlike a luminescent substance, the infrared absorbent feature substance does not provide an active signal that would facilitate analysis of the used substance.

Advantageously, the third feature substance does not yet have significant absorption even at a wavelength of about 800 nm, so that it cannot be detected with commercially available silicon-based infrared detectors. The third feature substance preferably has significant absorption only in the spectral range above about 1.2 μm, preferably in the spectral range between about 1.5 μm and about 2.2 μm. The infrared absorption of the third feature substance is then only detectable with elaborate and uncommon detectors, which gives the formed coding high falsification security.

In preferred embodiments of the invention, the infrared absorbent feature substance used is for example a substance based on doped semiconductor material. Substances containing a metal oxide are also suitable, being characterized in particular by their aging resistance. The third feature substance is preferably present in particle form with an average particle size smaller than 50 nm. This causes visible light to be scattered only little by the particles, so that the feature substance is colorless or has only weak inherent color in the visible.

Examples of the infrared absorbers used as the third feature substance in the invention, which do not have any appreciable absorption either in the visible or at about 800 nm, are 2,5-cyclo-hexadiene-1,4-diylidene-bis[N,N-bis(4-dibutylamino-phenyl)ammonium]bis(hexafluoroantimonate) with the totals formula $C_{62}H_{92}N_6F_{12}Sb_2$, the dyes ADS 990 MC with the totals formula $C_{32}H_{30}N_2S_4Ni$, or ADS 1120P with the totals formula $C_{52}H_{44}Cl_2O_6$ from Siber Hegner GmbH, Hamburg. According to an advantageous development of the invention, a fourth feature substance is applied to the value document substrate, preferably printed thereon. The fourth feature substance can be used for the authenticity check of the value document in addition or as an alternative to the first feature substance.

In a preferred embodiment of the invention, the presence of a first and/or fourth feature substance indicates the series or the particular existing upgrade e.g. of a bank-note issue. For example, only the first feature substance can be present in an originally issued currency, and the first and fourth feature substances in the upgrade of the currency. After a certain transition period it is conceivable to use only the fourth feature substance.

Besides the second feature substance, the first feature substance and/or the fourth feature substance can also be formed by a luminescent substance or a mixture of luminescent substances. For the first and/or fourth feature substance it is preferable to use luminescent substances or mixtures that emit in the infrared spectral range and that in particular have a complex, difficult-to-imitate spectral emission characteristic. Said emission characteristic can be used in particular for distinguishing the luminescent substances from similar luminescent substances. However, it can also be used for producing a coding by the form of the emission spectra or/and excitation spectra of the luminescent substances.

In an expedient embodiment of the inventive value document, the third feature substance is formed by an infrared absorbent feature substance, and the first feature substance by a luminescent substance emitting in the absorption range of the third feature substance. This makes it possible to utilize the interaction of the properties of the first and third feature substances for reading the coding, as described in detail below. The excitation of the first feature substance is advantageously effected in the infrared spectral range, preferably in the spectral range from about 0.8 μm to about 1.0 μm.

Preferably, at least one of the luminescent feature substances is a luminescent substance based on a host lattice doped with rare earth elements. It is also possible for several or all of the luminescent substances to be formed on the basis of such a doped host lattice. Said luminescent substances can be excited e.g. by irradiating directly into the absorption bands of the rare earth ions. In preferred variants, it is also possible to use absorbent host lattices or so-called sensitizers, which absorb the excitation radiation and transfer it to the rare earth ion, which then emits with luminescence. Obviously, the host lattices and/or the dopants can be different for the different feature substances in order to obtain different excitation and/or emission ranges.

In a preferred embodiment, the host lattice absorbs in the visible spectral range and optionally, in particular in the case of the first or fourth feature substance, additionally in the near infrared region up to about 1.1 μm. Excitation can then be performed with high effectiveness by light sources, such as halogen lamps, LEDs, lasers, flash lamps or xenon arc lamps, so that only small amounts of the luminescent substance are required. This firstly permits application of the luminescent substance by usual printing processes and, secondly, the small amount of substance impedes detection of the used substance by potential forgers. If the host lattice also absorbs in the near infrared up to about 1.1 μm, easily detectable emission lines of the rare earth ions can be suppressed, leaving only the emission at larger wavelengths that is more elaborate to detect.

In an alternative preferred embodiment, luminescent substances are used that absorb even in the visible spectral range, preferably over most of the visible spectral range, especially preferably into the near infrared region. Then, too, emissions in these more easily accessible spectral ranges are suppressed.

The host lattice can have for example a perovskite structure or a garnet structure and be doped with a rare earth element emitting in the infrared spectral range, such as praseodymium, neodymium, dysprosium, holmium, erbium, thulium or ytterbium. Further possible embodiments of the host lattice and the dopant are specified in EP-B-0 052 624 or EP-B-0 053 124, whose disclosures are included in the present application in this respect.

According to an advantageous embodiment of the inventive value document, the coding extends over a predominant part of a surface of the value document, in particular over the substantially total surface of the value document. This makes it possible to obtain a further increase in the falsification security of the value document, since gaps or inserted parts of other, including other authentic, documents manifest themselves as a disturbance of the coding.

For example, in the case of documents of the same kind, such as bank notes of the same denomination, the coding or a part of the coding can be provided with a certain offset from document to document. If the documents are produced in a continuous format, this can be obtained for instance by using a print roll whose circumference is a non-integral multiple of the document size. A row of successive documents can then contain a coding with the same content or the same form, the individual documents at the same time being distinguishable from each other due to the different offset. In sheet-by-sheet printing the same result can be achieved if several printing plates with mutually offset codings or coding parts are used according to the desired repetition rate.

The coding formed by the second and third feature substance can be any kind of signs or patterns, such as an alphanumeric character string. However, it is preferred in the context of the invention that the coding is a bar code. A bar code is understood here to mean any one- or two-dimensional pattern consisting of stripes or areas with the feature substances ("bars") and stripes or areas without feature substances located between the bars ("spaces"). As a rule, the bar/space sequence represents a binary number sequence representing any, also encrypted, information about the value document.

The bar code can in particular be invisible to the naked eye and be only detectable by its emission or absorption in a special spectral range after irradiation with a suitable light source. Bar codes are particularly suitable for machine readout and provide an almost fault-free read result, primarily in connection with check digits. Bar codes to be used are for example common formats, such as the 2/5 code, the 2/5 inter-leaved code, the 128 code or the 39 code, but also special formats used only for the inventive value documents. It is also possible to use two-dimensional bar codes offering a particularly strongly condensed recording and increased redundancy, which makes them insensitive to production tolerances.

The value document substrate is preferably a printed or unprinted cotton fiber paper, cotton/synthetic fiber paper, a cellulosic paper or a coated, printed or unprinted plastic film. A laminated multilayer substrate can also be used. The material of the substrate is not essential to the invention, provided that it only allows incorporation or application of the particular feature substances required. Obviously, the value document can be provided with further feature substances or further printed layers, besides the substances mentioned.

The inventive value documents are preferably bank notes, shares, credit cards, badge or identity cards, passports of any type, visas, vouchers, etc.

Application of the second and third feature substances to the value document substrate is done according to the invention using a printing process. It is possible to use for example a gravure, screen, letterpress, flexographic, ink-jet, digital, transfer or offset printing process. The printing inks used for this purpose can be transparent or contain additional coloring pigments which must not impair detection of the feature substances. In the case of the luminescent substances, they preferably have transparent areas in the excitation range and the viewed emission range of the luminescent substances.

If a fourth feature substance is provided, it can fundamentally be applied to the value document in any form and distribution. However, it is preferred to print the fourth feature substance on the value document substrate likewise in the form of a coding. According to an advantageous embodiment, the fourth feature substance can be admixed to a printing ink, in particular a visible printing ink, and be printed on the value document substrate together with said printing ink. The fourth feature substance is as a rule applied separately from the second and third feature substances, but can also be printed together therewith in a joint printing ink.

The codings formed by the second and third, and the fourth feature substance can be of the same type or of different types. For example, the second and third feature substances can be applied in the form of a bar code, and the fourth feature substance in the form of an alphanumeric character string.

In an advantageous development of the invention, the value document has a further printed layer which partly or completely covers the value document areas provided with the second and third feature substances. In particular, the printed layer can be opaque in the visible spectral range, and transparent or translucent in the emission range of the second feature substance and/or in the absorption range of the third feature substance. The printed layer then hides the presence of the second and third feature substances in the visible spectral range, but permits detection of the luminescence of the second feature substance or the absorption of the third feature substance at the corresponding wavelengths. If the printed layer completely covers the value document areas provided with the second and third feature substances, it must be transparent or translucent both in the emission range of the second feature substance and in the absorption range of the third feature substance to permit detection of the particular feature properties.

Obviously, further feature substances can be applied, or incorporated into the substrate, e.g. to further increase the falsification security or to include further user groups.

In a method for checking or processing an above-described value document, the authenticity of the value document is checked and a value recognition of the document carried out by using at least one characteristic property of the first and/or second feature substance for checking the authenticity of the value document, and the coding formed by the second and/or third feature substance for value recognition of the value document. The authenticity and the value recognition of the value document are preferably determined by different user groups using different feature substances. That is, if the user belongs to a first user group, the authenticity of the value document is determined using at least one characteristic property of the first feature substance, and the value recognition carried out by means of the coding represented by the third feature substance. If the user belongs to a second user group, said user has at its disposal at least one characteristic property of the second feature substance for authenticity recognition, and the coding formed by the second feature substance for value recognition. The checking systems of the different user groups are thus completely decoupled, since different feature substances are evaluated. This means that if forgeries occur in one user group, this security hole does not affect any other user groups.

If the value document is provided with a fourth feature substance, the check or processing by a user of the first user group can be done by using at least one characteristic property of the first and/or fourth feature substance for checking the authenticity of the value document. The coding formed by the third feature substance is used for value recognition of the value document here, too. For example, some of the users from the first user group can use the first feature substance for the authenticity check, and others the fourth feature substance. The check or processing by users of the second user group remains unchanged.

In both method variants, the value recognition by a user of the first user group is preferably done by irradiating the coding with radiation from the absorption range of the third feature substance, determining the absorption of the coding at a wavelength from the irradiation range, and performing the value recognition on the basis of the measured absorption.

Irradiation of the coding is advantageously done here in the infrared spectral range, and the absorption is expediently determined by a spatially resolved measurement of the transmitted and/or remitted infrared radiation.

Alternatively, the value recognition by a user of the first user group can be done by irradiating at least a partial area of the value document with radiation from the excitation range of the luminescent first feature substance, determining the emission of the first feature substance at a wavelength from the absorption range of the third feature substance, and performing the value recognition on the basis of the measured emission.

This alternative variant is based on an interaction between the properties of the first and third feature substances. It presupposes that the first feature substance is a luminescent substance emitting in the absorption range of the third feature substance. The absorption of the third feature substance is not determined via a remission or transmission measurement, as in the above-described method, but via the luminescence emission of the first feature substance locally suppressed in the area of the coding. In a preferred embodiment, the third feature substance does not absorb at a certain emission wavelength of the first feature substance, while it absorbs at least part of the emission radiation at a certain emission wavelength of the fourth feature substance. The emission of the first feature substance at a certain wavelength is thus the expected 100%, while the emission of the fourth feature substance at another certain wavelength is e.g. 50% based on the expected 100%. A certain absorber can thus be easily detected with the help of these special emission and absorption characteristics in the total spectrum. It thus does not suffice to use any absorbent substance in the forgery, the absorber must also have a very specific spectrum that interacts with the spectrum of the first and/or fourth feature substance.

In this variant, too, irradiation is preferably done in the infrared spectral range, for example at 0.8 μm to 1.0 μm, and the emission is measured in spatially resolved fashion for detecting the local absorption.

The described method additionally allows a normalization of the measured emission pattern. If the absorbent coding print is located on the front of the value document, the luminescence emission on the back is measured along with the absorption modulated luminescence emission on the front. The value document is irradiated with excitation light from the back, and the substantially constant back emission of the first marking substance recorded as a reference value. The front emission can then be related to said reference value and thereby normalized. Alternatively, it is also possible to normalize the modulated front luminescence emission to the emission of the unprinted areas.

Users of the second user group advantageously irradiate the coding with radiation from the excitation range of the second feature substance for the authenticity check and value recognition. The emission of the coding is determined at least one wavelength from the emission range of the second feature substance, and the check of authenticity and/or the value determination is carried out on the basis of the determined emission. The second feature substance is preferably irradiated with visible and/or infrared radiation, and the emission of the second feature substance is determined in the infrared spectral range.

In all described method variants, irradiation is advantageously carried out with a light-emitting diode or laser diode.

The use of the infrared absorbent third feature substance for the first user group has increased security compared with the luminescence coding formed by the second feature substance. Besides the advantages already mentioned, the automatic readability of the IR coding is only little disturbed by a background print therebelow. Secondly, soiling is considerably less disturbing in the infrared spectral range than in the visible and the ultraviolet spectral ranges. Also, the signal-to-noise ratio of a measuring head is considerably better in remission measurements than in luminescence measurements, so that a higher resolution can be obtained.

Further embodiments and advantages of the invention will be explained hereinafter with reference to the figures. For clarity's sake, the representation in the figures is not true to scale or to proportion.

DETAILED DESCRIPTION OF VARIOUS EMBODIMENTS

Figure 1:
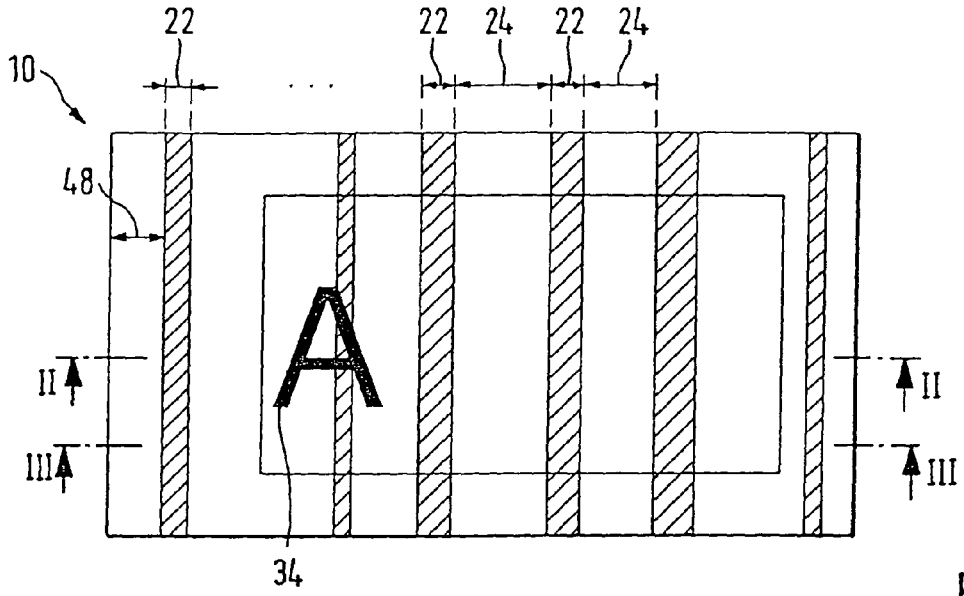
FIG. 1 a schematic representation of a bank note according to one embodiment of the invention, FIG. 2 a section through the bank note of FIG. 1 along the line II-II, FIG. 3 the pattern of infrared absorption of the bank notes of FIG. 1 and FIG. 5, along the line III-III in each case, FIG. 4(*a*) the pattern of luminescence emission measured on the back of the bank notes along the line III-III, (*b*) the pattern of luminescence emission measured on the front of the bank notes along the line III-III, and FIG. 5 a schematic representation of a bank note according to another embodiment of the invention.
Figure 2:
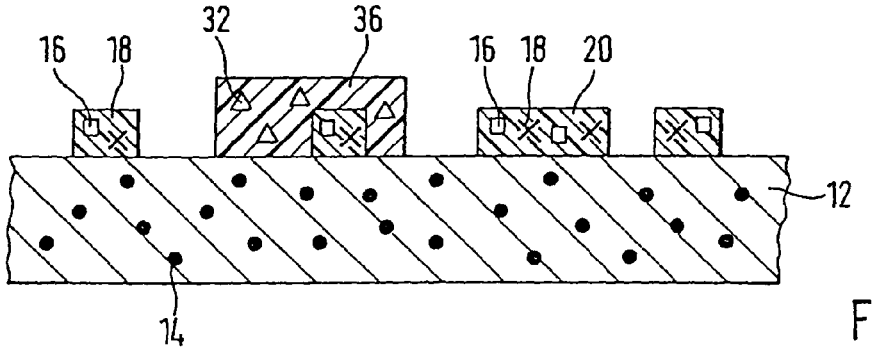

The invention will now be explained by the example of a bank note. FIGS. 1 and 2 show schematic representations of a bank note 10 equipped with different feature substances for a check by different user groups. FIG. 1 shows the bank note 10 in a plan view and FIG. 2 a cross section along the line II-II of FIG. 1.

As seen best in FIG. 2, a first feature substance 14 is distributed in the form of particles uniformly within the volume of the paper substrate 12 of the bank note 10. The particles of the first feature substance 14 can be added to the paper stock or fibrous pulp before sheet formation or be incorporated into the fibrous matrix only after sheet formation.

In the embodiment, the first feature substance 14 is a mixture of different luminescent substances which, after excitation, emits radiation with a complex and difficult-to-imitate spectral distribution in the infrared spectral range.

A second feature substance 16 and a third feature substance 18 are printed in a printing ink 20 jointly and in stripe form on the front of the bank note 10. The width of the individual stripes 22 and the width of the particular spaces 24 constitute a bar code in which the denomination and the currency of the bank note 10 are stored in encrypted form. The bar code 22, 24 extends substantially over the total surface of the bank note 10.

In this embodiment, the second feature substance 16 is formed by a luminescent substance and the third feature substance 18 by an infrared absorbent material. Unlike the first feature substance 14, the second feature substance 16 is selected specifically so that its luminescence can be excited easily and detected with commercially available detectors.

The infrared absorbent third feature substance 18 is transparent in the visible spectral range up to wavelengths of about 0.8 μm, so that its presence in the bar code 22, 24 is neither recognizable by the naked eye nor can it be detected with commercially available infrared detectors.

The authenticity check and the value recognition can now be carried out by two different user groups using different combinations of the feature substances 14, 16 and 18, or their arrangement. The bank note 10 of the embodiment is designed for a first user group with high security requirements and a second user group with comparatively low security requirements.

The second user group can involve for example simple machines taking bank notes in parking lots, or vending machines. For this use it is particularly expedient to employ inexpensive detection apparatuses for the authenticity check and value recognition.

A user of the second user group checks the authenticity of a bank note 10 by irradiating the bank note with light from the excitation range of the second feature substance 16 and detecting the corresponding luminescence signal. If a correct luminescence signal is received, the bank note is rated as authentic by the user. Due to the choice of the luminescent substance 16 this detection can be done with commercially available, inexpensive detectors. If the bank note is recognized as authentic, its value can be taken, if required, from the coding 22, 24 likewise formed by the luminescent substance 16. The authenticity check and the value recognition can of course also be carried out in one step.

The first feature substance 14 with its complex spectral emission serves as an authenticity mark for the first user group with its higher security requirements. The first user group can comprise for example banks, where the authenticity of the bank notes is checked with high-quality and elaborate detectors. Here, a bank note is irradiated for the check with light from the excitation range of the first feature substance 14, and the correct spectral response of the feature substance evaluated. The authenticity check is preferably based not only on detection of the correct luminescence emission, but also on an in-depth analysis of the emission spectrum, whereby half-widths and/or luminescence peak intervals and/or decay times, etc., are rated.

Figure 3:
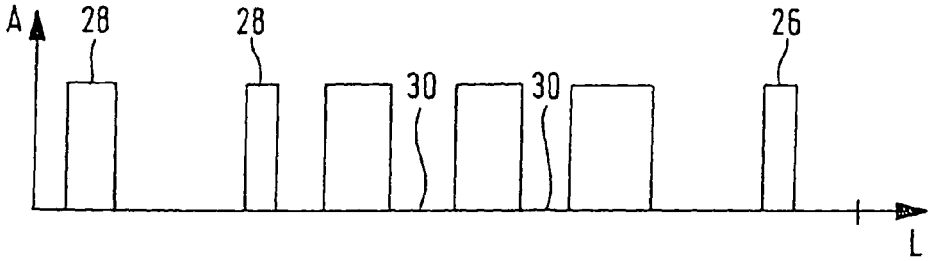

Value recognition of the bank note is performed by a user of the first user group with the help of the infrared absorbent third feature substance 18. As mentioned above, the feature substance 18 is transparent in the near infrared but absorbent at greater wavelengths, in the embodiment in the range around 1.5 μm. The information content of the bar code 22, 24 can thus be read by a remission measurement with an elaborate infrared detector at a wavelength of 1.55 μm. FIG. 3 schematically shows for this purpose the pattern of the infrared absorption 26 measured at 1.55 μm, along the line III-III of FIG. 1. The information coded in the line pattern 22, 24 can be read from the sequence of the absorption maxima 28 and absorption minima 30 if the scheme is known.

The elaborate evaluation of the coding 22, 24 with the help of the infrared absorbent third feature substance at the same time carries out an additional authenticity check of the bank note 10 for the first user group. If no, or an incorrect, coding is recognized in the infrared absorption 26 during the value recognition, the bank note can be classified as inauthentic, even if the check of the first feature substance did not show anything unusual. An imitation of the coding with the luminescent second feature substance, e.g. due to an analysis of a detection apparatus of the second user group, is also insufficient for deceiving the value recognition of the first user group.

Both user groups use nonoverlapping feature substance systems for the authenticity check and value recognition. This results in the essential advantage that an analysis of a comparatively easily accessible apparatus for detection of authenticity of the second user group does not give any indication of the procedure and basic principles of the authenticity check or the value recognition of the first user group. The system has the advantage that both user groups check the identical information, since both value recognition substances are printed in a joint mixture in coded form, and value recognition is nevertheless completely decoupled by the check of different physical properties.

In addition to the stated feature substances, a fourth feature substance 32 can be printed on the bank note 10 in the form of a further coding 34. The further coding can likewise be formed as a bar code or also as an alphanumeric character string, as indicated in FIG. 1. In this embodiment, the fourth feature substance is a further luminescent substance 32 admixed to a visible printing ink 36. The printing ink 36 and the luminescent substance 32 are used to print a printed image, for example the denomination and the currency of the note, or a graphic motif on the bank note substrate 12.

In this embodiment, the fourth feature substance 32 is a luminescent substance based on a host crystal doped with a rare earth element, which when excited in the visible spectral range shows a luminescence in the infrared spectral range at about 2.0 μm and does not emit in the visible and in the near infrared. The luminescence of the fourth feature substance 32 cannot be detected with common detectors, which are sensitive up to at most 1.1 μm. The fourth feature substance 32 can therefore be employed by the users of the first user group for a high-quality authenticity check alternatively or in addition to the first feature substance 14.

A further variant of the value recognition of the bank note by a user of the first user group will now be explained in connection with FIG. 4. For this variant, the first feature substance 14 selected is a luminescent substance that emits above 1.2 μm, in particular at the subsequently used test wavelength of 1.55 μm. As mentioned, luminescent substances based on rare earth metal doped host lattices have such an IR emission.

Figure 4A:
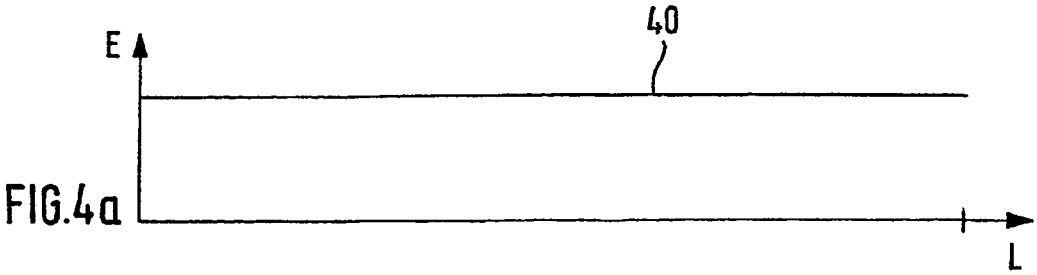
Figure 4B:
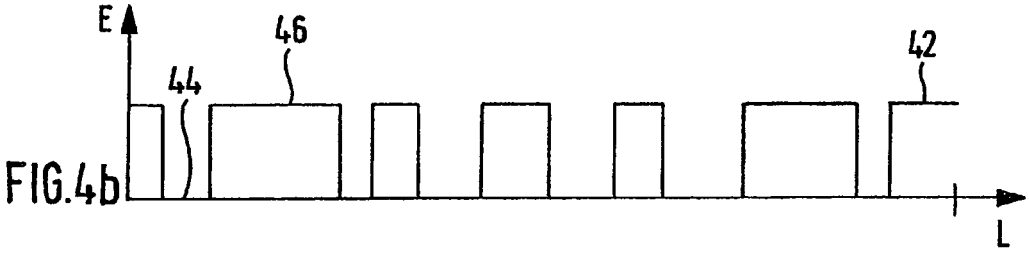

FIG. 4(*a*) shows the pattern 40 of the luminescence emission measured on the back of the bank note, along the line III-III at the test wavelength of 1.55 μm after excitation of the first feature substance 14. Since the first feature substance 14 is distributed uniformly within the substrate 12 and the back of the bank note does not contain any absorbent structures, there is a constant emission signal 40 whose magnitude can serve as a reference value for the subsequent front measurement.

If the luminescence emission is measured along the line III-III on the front of the bank note 10, the result is the pattern 42 shown in FIG. 4(*b*). At the places where the line III-III crosses the stripes 22 of the coding, the luminescence emission of the first feature substance 14 is absorbed by the third feature substance 18, so that a minimum 44 arises in the luminescence pattern 42. In contrast, the emitted radiation passes through the spaces 24 of the coding, possibly with a certain attenuation due to further printed layers of the bank note, and leads to areas 46 with a large luminescence signal in the luminescence measurement. The coded information can be read out again via the width of the luminescence maxima and minima.

The last-described readout method for the coding 22, 24 is based on an interaction of the substance properties of the luminescent substance 14 and the infrared absorbent feature substance 18 which is exceptionally difficult to imitate for a forger and therefore offers very high protection from forgery.

Referring again to FIG. 1, the first stripe 22 of the coding is disposed at a certain distance 48 from the left edge of the bank note 10. If said distance 48 is varied for different bank notes of the same series, for example by using different printing plates with different distances 48, this results in additional protection from forgery, since gaps or inserted parts of other bank notes manifest themselves as a disturbance in the coding 22, 24 for both user groups.

For example, it can be provided that only certain combinations of stripe widths 22 and space widths 24 form permissible codings. Stripes that are too wide or too narrow, as can easily appear upon attempts at tampering with the bank note, are recognized as impermissible in the check of the bank notes and the bank note rejected as being tampered with.

Figure 5:
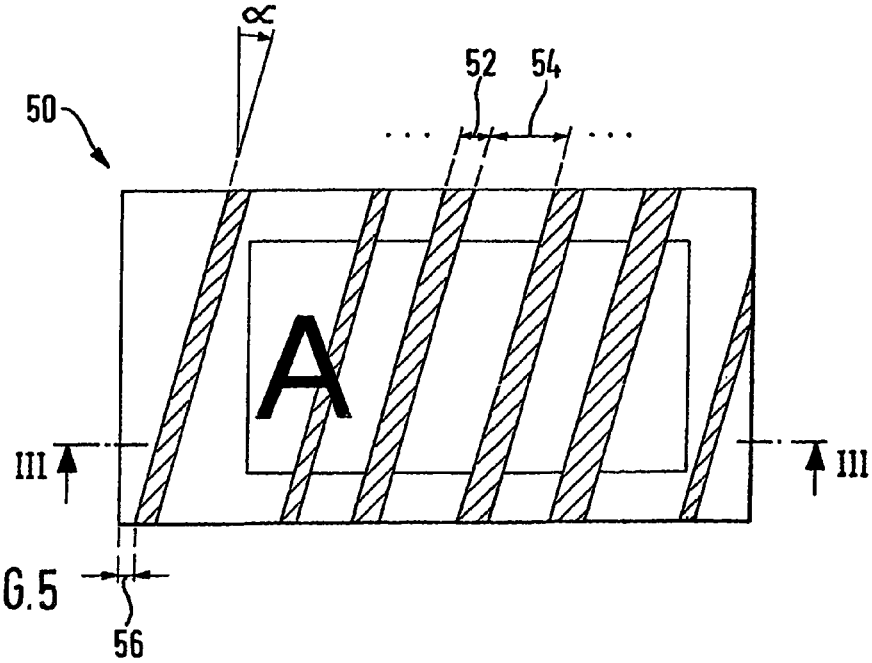

A further embodiment of an inventive bank note 50 is shown in FIG. 5. Unlike the bank note of FIG. 1, the bank note 50 has the stripe coding 52, 54 tilted by a certain angle α against the vertical. The first stripe 52 has on the bottom edge of the bank note 50 a certain distance 56 from the left edge of the note, which is varied within the bank notes of a series. Attempts at tampering with the bank note 50 are thereby easily recognizable to both user groups, since gaps or inserted parts of other notes immediately lead to a noticeable disturbance of the tilted stripe pattern.

If the absorption or emission is measured only along the line III-III, the same results are obtained as described above in connection with the bank note 10 of FIG. 1.

The invention claimed is:

1. A value document, comprising a value document substrate and different feature substances for checking the value document, a first feature substance incorporated into the volume of the substrate of the value document;

second and third feature substances provided on the value document substrate in a printing ink jointly and in the form of a coding, wherein the second feature substance comprises a luminescent substance, and the third feature substance comprises a material absorbent in an infrared spectral range, wherein the first feature substance is formed by a luminescent substance emitting in the absorption range of the third feature substance and the third feature substance does not absorb at a certain emission wavelength of the first feature substance; and a fourth feature substance is applied to the value document substrate different from the first, second and third feature substances, wherein the third feature substance absorbs at least part of the emission radiation at a certain emission wavelength of the fourth feature substance.

2. The value document according to claim 1, wherein the first feature substance is distributed substantially uniformly within the volume of the value document substrate.

3. The value document according to claim 1, wherein the third feature substance is substantially colorless or has only weak inherent color in the visible spectral range.

4. The value document according to claim 1, wherein the third feature substance absorbs in a spectral range selected from the group consisting of the range above about 1.2 μm, and the range from about 1.5 μm to 2.2 μm.

5. The value document according to claim 1, wherein the third feature substance has no significant absorption at a wavelength of about 0.8 μm.

6. The value document according to claim 1, the third feature substance comprises one of a doped semiconductor material or a metal oxide.

7. The value document according to claim 1, wherein the third feature substance is present in the printing ink in particle form with an average particle size smaller than 50 nm.

8. The value document according to claim 1, wherein the first and/or fourth feature substance is formed by a luminescent substance or a mixture of luminescent substances.

9. The value document according to claim 1, wherein at least one of the feature substances is formed on the basis of a host lattice doped with rare earth elements.

10. The value document according to claim 1, wherein the coding extends over a predominant part of a surface of the value document.

11. The value document according to claim 10, wherein the coding extends over substantially the total surface of the value document.

12. The value document according to claim 1, wherein the coding is a bar code.

13. The value document according to claim 1, wherein the coding is information about the value document.

14. The value document according to claim 13, wherein the information is in encrypted form.

15. The value document according to claim 1, wherein the value document substrate comprises a printed or unprinted cotton paper.

16. The value document according to claim 1, wherein the value document substrate comprises a printed or unprinted plastic film.

17. The value document according to claim 1, wherein the fourth feature substance is a printing on the value document substrate together with a printing ink in the form of a printed image.

18. The value document according to claim 17, wherein the printed image is a coding.

19. The value document according to claim 18, wherein the coding is one of a bar code and an alphanumeric character string.

20. The value document according to claim 1, wherein the value document has a further printed layer which partly or completely covers the value document areas provided with the second and third feature substances.

21. The value document according to claim 20, wherein the further printed layer is opaque in the visible spectral range and is transparent or translucent in at least one of the emission range of the second feature substance and in the absorption range of the third feature substance.

22. The value document according to claim 20, wherein the further printed layer is formed by the printing ink containing a fourth feature substance, said fourth feature substance comprising a print in the form of a printed image.

* * * * *